US007387219B2

(12) United States Patent
Leick

(10) Patent No.: US 7,387,219 B2
(45) Date of Patent: Jun. 17, 2008

(54) DISPENSING CAP APPARATUS

(76) Inventor: Robert T. Leick, 4223 Heathcote Rd., Wayzata, MN (US) 55391

( * ) Notice: Subject to any disclaimer, the term of this patent is extended or adjusted under 35 U.S.C. 154(b) by 372 days.

(21) Appl. No.: 10/785,764

(22) Filed: Feb. 24, 2004

(65) Prior Publication Data

US 2005/0072803 A1 Apr. 7, 2005

Related U.S. Application Data

(60) Provisional application No. 60/507,970, filed on Oct. 2, 2003.

(51) Int. Cl.
*B67D 5/62* (2006.01)

(52) U.S. Cl. ..... 222/146.1; 222/1; 222/146.2; 222/146.3; 222/146.4; 222/402.1

(58) Field of Classification Search ..... 222/1, 222/146.1, 146.2, 146.3, 146.4, 146.5, 402.1, 222/182–183

See application file for complete search history.

(56) References Cited

U.S. PATENT DOCUMENTS 3,095,122 A 6/1963 Lewiecki et al.
3,111,967 A 11/1963 Bullard
3,175,733 A 3/1965 Lerner
3,217,937 A 11/1965 Kasparian
3,236,420 A * 2/1966 Leika ..... 222/146.3
3,314,572 A 4/1967 Pungitore
3,338,477 A * 8/1967 McKinnie et al. ..... 222/146.3
3,341,079 A 9/1967 Marraffino
3,399,810 A * 9/1968 Burne ..... 222/146.3
3,618,810 A * 11/1971 Wilson ..... 220/212
3,722,753 A * 3/1973 Miles ..... 222/146.3
4,024,987 A 5/1977 Myles
6,655,552 B2 12/2003 Aiken et al.

* cited by examiner

*Primary Examiner*—Frederick C. Nicolas
(74) *Attorney, Agent, or Firm*—Dicke, Billig, & Czaja, P.L.L.C.

(57) ABSTRACT

A dispensing cap permits the contents of a canister to be heated prior to being dispensed. The cap includes a dispensing mechanism and is designed to be mounted to the top of a canister containing a product. Small apertures spaced about the cap permit heated water from a faucet or other source to enter the cap and flow over the top of the canister below and within the cap. The heated water warms the top of the canister, interior dispensing mechanism, and the contents of the canister. As a result, the contents of the canister are warm when dispensed. When used with a shaving cream or gel canister, for example, the heated contents provide a more comfortable shave than contents dispensed at a colder room temperature.

13 Claims, 3 Drawing Sheets

DISPENSING CAP APPARATUS

RELATED APPLICATION

The present application claims the benefit of U.S. Provisional Application Ser. No. 60/507,970, filed Oct. 2, 2003, which is incorporated herein in its entirety by reference.

FIELD OF THE INVENTION

The present invention relates generally to dispenser canister caps, and more particularly to caps for pressurized shaving cream or gel dispensing canisters.

BACKGROUND OF THE INVENTION

Shaving cream and gel products are typically packaged in pressurized metal canisters and can be purchased by consumers at drug, discount, and grocery stores. The canisters are generally stored in the home at room temperature, usually in a medicine cabinet or other bathroom cupboard, resulting in a dispensed shaving product that is at room temperature or a slightly lower temperature due to the insulating effect of the metal canister.

To provide a more pleasant shaving experience, it is often desired to warm shaving cream or gel prior to applying it to the skin. A warmed shaving product provides a more comfortable and effective shave by opening skin pores, softening facial hair, and soothing shave-abraded skin.

To heat the contents of ordinary shaving cream or gel canisters in the home, the canister must be placed in standing hot water or held under running water. Because the product that it is most desired to warm is the product that will be dispensed first, generally located at the very top of a pressurized canister, these methods of warming the canister and contents are inefficient and most often not effective at reaching the desired product because it is located within the canister beneath the dispensing mechanism. Barbers and other professionals use electric heating devices that dispense a warm shaving lather mixed with hot water. Electric heating devices used by barbers, however, are expensive and are often too bulky to be used in a home environment by an ordinary consumer.

Other attempts have been made to create a device to warm shaving products. For example, U.S. Pat. No. 3,095,122, to Liewiecki et al., discloses a device for dispensing the contents of a pressurized dispenser in a warmed condition. A cylindrical heat-conductive chamber is permanently attached to a can and the chamber is closed by a cover and filled with a heat-conductive and distributing material, for example metallic wool. In use, the chamber is heated by holding it under a hot water faucet or in a hot air blast.

U.S. Pat. No. 6,655,552, to Aiken et al., discloses a heat transfer cap assembly for use with a dispensing canister containing a pressurized product. The cap assembly defines a volume for retaining hot tap water to heat gel in a thermal conductor forming a conduit between a nozzle adaptor and an outlet in the side of the cap assembly. An initial use of the dispenser assembly will require depressing a trigger button to fill the gel conduit with pressurized shaving product for heating.

U.S. Pat. No. 3,217,937, to Kasparian, discloses a pressurized dispensing can that has a main compartment for storing the product to be dispensed and a hot water compartment that is an integral part of the can above the main compartment. In use, a cap on the hot water compartment is removed, hot water is run into the compartment, and the cap is replaced.

U.S. Pat. No. 4,024,987, to Myles, discloses a device for a pressurized container that is detachably threaded onto the end of a water faucet for a continuous supply of hot water therefrom to heat a lather product in the container. U.S. Pat. No. 3,111,967, to Bullard, discloses another approach. In the Bullard patent, material from a can is dispensed into the cap and the cap is held under hot running water to heat the dispensed material in the cap. The cap is then removed from the running water and the shaving lather is taken out of the cap by the fingers and applied to the shaver's face.

In U.S. Pat. No. 3,175,733, to Lerner, the contents of a dispenser are discharged into a circuitous passage within a unit attachable to the top of an aerosol dispenser. The contents are heated within the passage by hot water that is placed in the unit through an opening on the top cover.

While the above-described devices provide a warmed shaving product, the devices are complex, expensive to manufacture, and not compatible with commercially available shaving cream and gel canisters. Therefore, there is a need for a simple, inexpensive device for quickly and effectively heating the contents of a shaving cream or gel canister.

SUMMARY OF THE INVENTION

The present invention substantially meets the aforementioned needs and provides a simple, cost-effective device for use with standard, commercially available shaving cream and gel dispensing canisters.

A preferred embodiment of the canister cap of the present invention is designed to be mounted on the top of a pressurized shaving cream or gel canister and permits the contents of the canister to be heated prior to being dispensed from the canister. The canister cap comprises an outer cap body having a plurality of spaced apertures, and an integrated dispensing mechanism. The dispensing mechanism comprises a depressible dispensing tab that forms a top portion of the cap body and an interior tube that is coupled at one end to the canister and at another end to an external dispensing aperture.

In use, the plurality of apertures in the outer cap body permit heated water from a faucet or other source to enter the cap body and flow over the top surface of the canister below and within the cap body. The heated water warms the top of the canister, the interior tube, and the contents of the canister. As a result, the contents of the canister are warm when the depressible dispensing tab is depressed to dispense a quantity of the contents of the canister.

The design of the dispensing cap of the present invention permits heated water to flow into and drain from the dispensing cap through the apertures without entering the canister itself or contacting the dispensed contents, thus not affecting the storage of the canister or the integrity of the contents. The dispensing cap is inexpensive to manufacture and is compatible with a wide array of canisters in which shaving cream and gel are currently sold. Further, the size or shape of the dispensing cap may be easily altered to adapt to canisters of varying sizes and shapes. The dispensing cap may also be used with products other than shaving cream or gel where it is desired to dispense a warmed product from a canister.

The above summary of the present invention is not intended to describe each illustrated embodiment or every implementation of the present invention. The figures and the detailed description that follow more particularly exemplify these embodiments.

BRIEF DESCRIPTION OF THE DRAWINGS

The present invention may be more completely understood in consideration of the following detailed description of various embodiments of the invention in connection with the accompanying drawings, in which.

Figure 1:
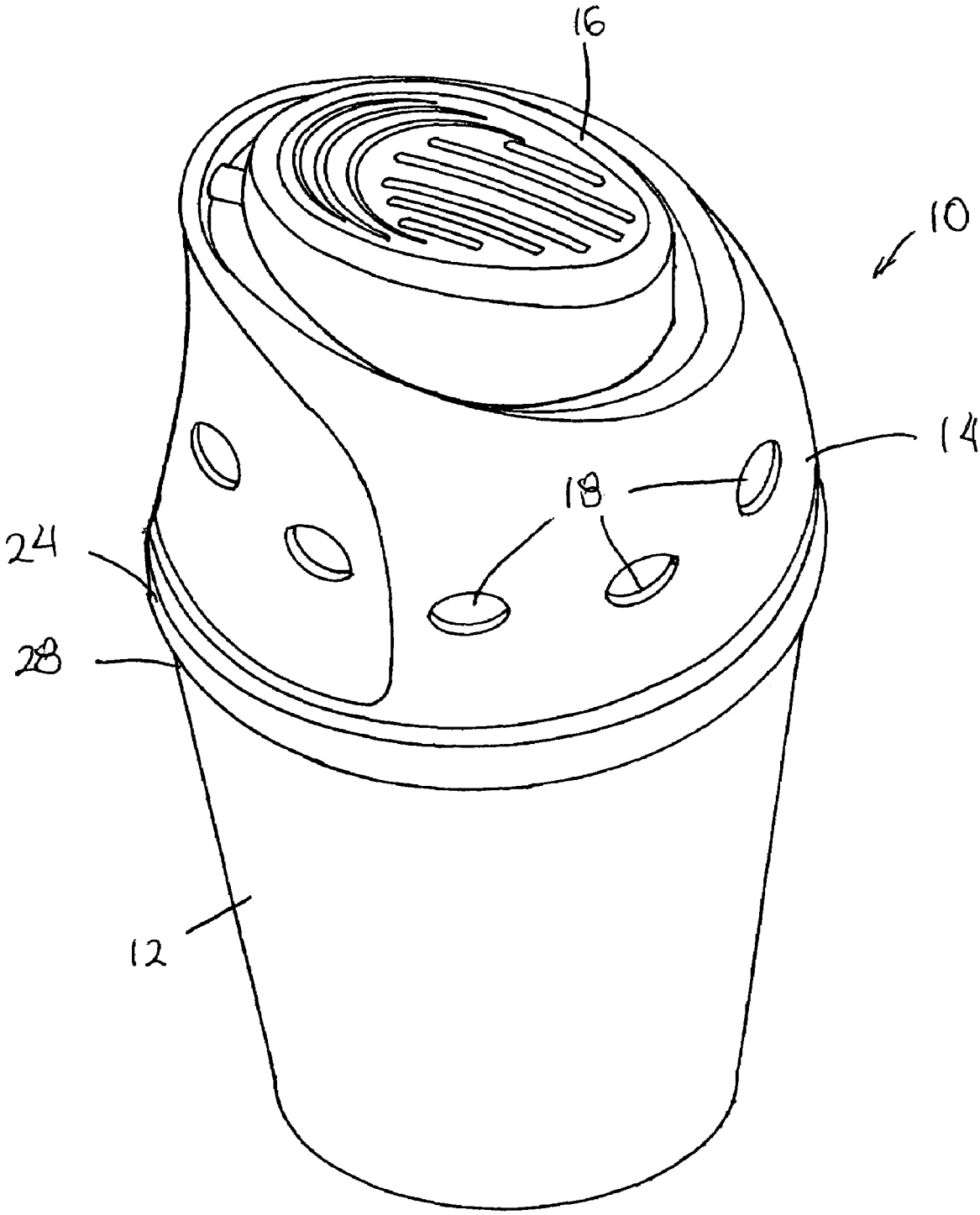
FIG. 1 is a side view of the dispensing cap on a canister according to a preferred embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

The present invention can be more readily understood by reference to FIGS. 1-4 and the following description. While the present invention is not necessarily limited to such an application, the invention will be better appreciated using a discussion of example embodiments in a specific context.

Figure 2:
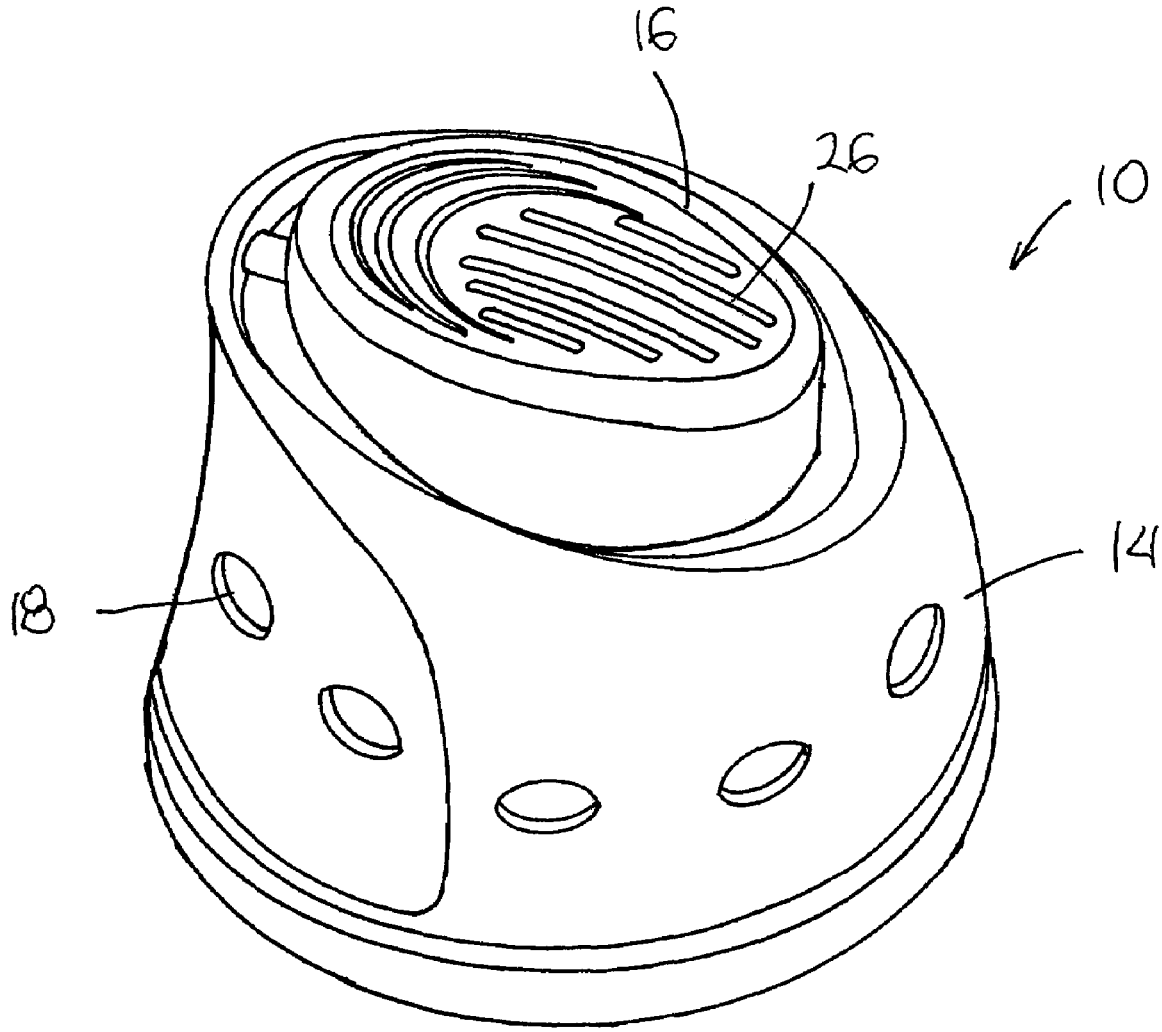
FIG. 2 is a top view of the dispensing cap on a canister according to a preferred embodiment of the present invention.
Figure 3:
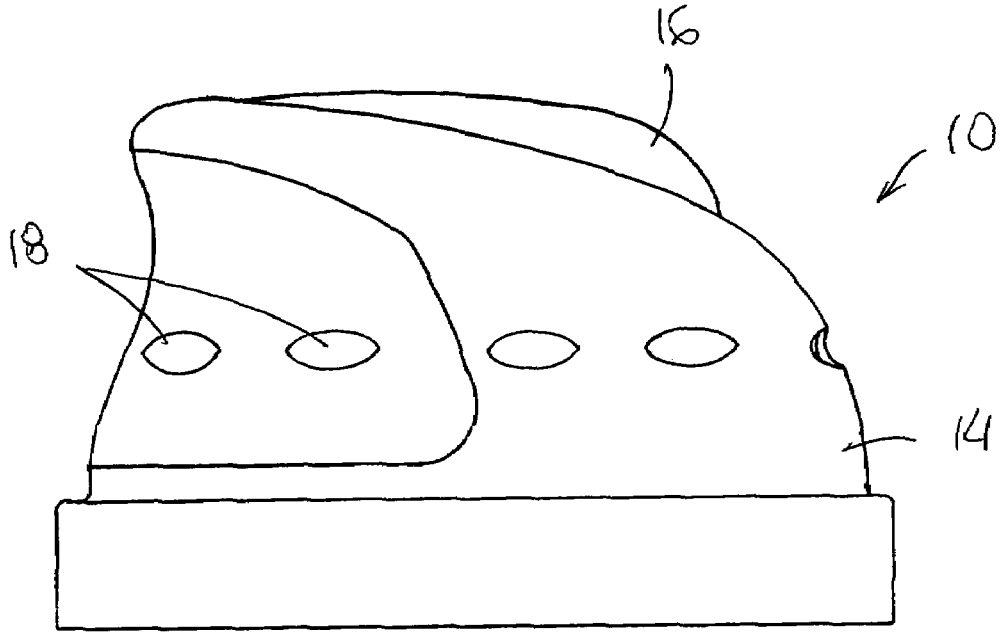
FIG. 3 is a top view of the dispensing cap according to a preferred embodiment of the present invention.

Referring to FIGS. 1-3, a dispensing cap 10 is fixedly coupled to a canister 12. The dispensing cap 10 preferably substantially covers an upper surface of the canister 12. The dispensing cap 10 thereby enhances the appearance of the canister 12. The dispensing cap 10 also preferably enhances the ability to dispense shaving cream or gel from the canister 12.

The dispensing cap 10 comprises a cap body 14 including a mounting flange 24, a depressible dispensing tab 16, and a plurality of small apertures 18 in the cap body 14. The mounting flange 24 enables the dispensing cap 10 to be fixedly coupled to a rim or lip 28 on a canister 12. The general structure and appearance of the mounting flange may vary to enable the dispensing cap 10 to be coupled to a wide variety of canisters 12.

The cap body 14 is preferably molded plastic or a similar material known to those having skill in the art and defines a hollow interior cavity that allows heated water to collect in the dispensing cap 10 after entering through one or a plurality of the apertures 18. The cap body 14 may vary in appearance without departing from the spirit and scope of the present invention. For example, the cap body 14 may have a particular shape, size, and color to match a corresponding canister.

The general appearance of the cap body 14 may also vary according to the application. For example, a cap body 14 used on a shaving cream canister may have a different overall shape from a cap body 14 used on a gel dispenser to assist consumers in quickly differentiating products from among an array on a store shelf.

The cap body 14 may also have an ergonomic shape to provide a more easily graspable canister 12. The plurality of apertures 18 may vary in size and placement but are preferably arranged so as to permit heated water to flow into and out of the cap body 14 regardless of the orientation of the canister 12.

The depressible dispensing tab 16 preferably forms a top surface of the dispensing cap to provide an ergonomic design. The depressible dispensing tab 16 and cap body 14 are preferably not closely interconnected to provide a gap between the tab 16 and the cap body 14. This gap allows water to flow into and out of the cap body in addition to the plurality of apertures 18 to aid in heat transfer.

In a preferred embodiment, depressible dispensing tab 16 comprises a textured upper contact surface 26 that permits a user to securely depress the tab 16, even when a user's hand or the contact surface 26 are wet.

Figure 4:
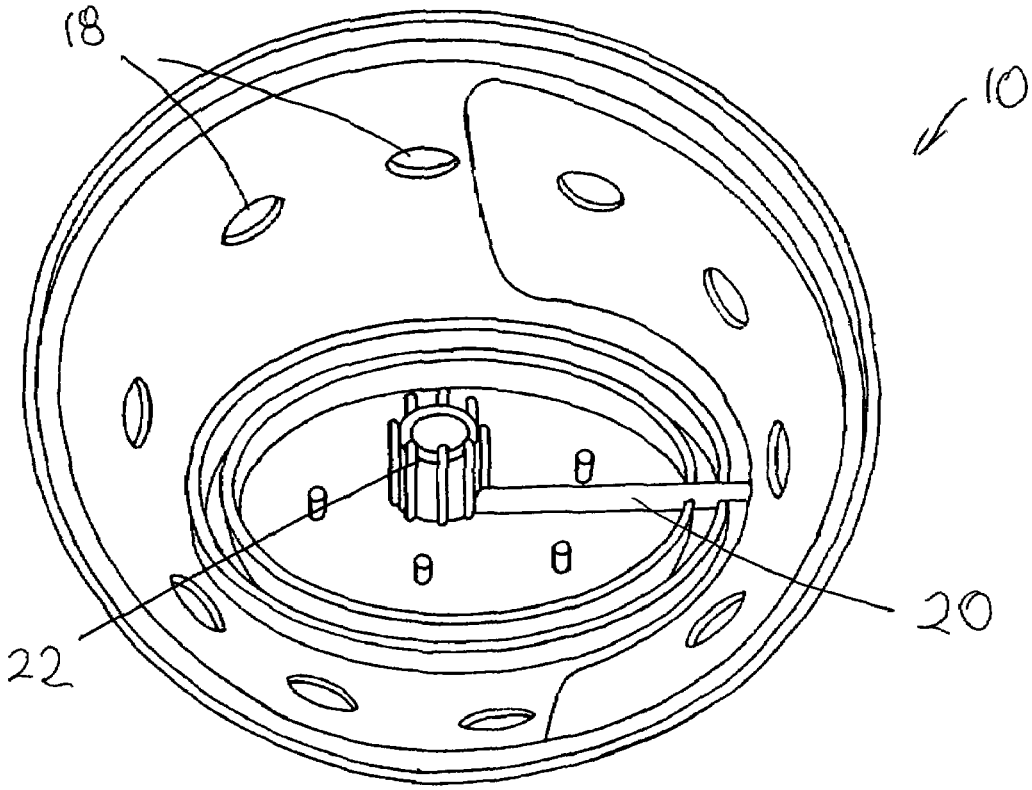
FIG. 4 is a view of the interior of the dispensing cap according to a preferred embodiment of the present invention.

Referring to FIG. 4, the dispensing cap 10 further comprises an interior tube 20 that is coupled on a first end to a dispensing aperture (not visible) on the cap body 14. A second end of the interior tube 20 is coupled to a connector 22 that operably attaches to a dispensing valve or mechanism on the canister (not shown). The depressible dispensing tab 16 is in operable communication with the dispensing valve or mechanism such that selectively depressing the tab 16 opens the valve to dispense product through the tube and the external dispensing aperture.

In use, a canister 12 with a dispenser cap 10 is immersed in heated water, for example in a sink, such that the water enters the dispensing cap 10 through the plurality of apertures 18 and flows through the dispensing cap 10 and over the top of the canister 12. The canister 12 and dispenser cap 10 may also be held under a stream of running water from a faucet.

After the water has been permitted to heat the dispensing cap 10, canister 12, and canister contents, the canister 12 is removed from the water and any water remaining in the dispensing cap 10 is drained through the plurality of apertures 18. The dispensing tab 16 is then depressed to dispense a desired amount of heated product from the canister 12. This process may be repeated as necessary to heat additional product.

The present invention may be embodied in other specific forms without departing from the essential attributes thereof. Therefore, the illustrated embodiments should be considered in all respects as illustrative and not restrictive.

The invention claimed is:

1. A method of changing a temperature of a product that is to be dispensed from a dispensing canister, the method comprising the steps of:

forming a dispenser cap comprising a cap body defining an interior cavity, wherein the cap body has a dispensing mechanism and a plurality of apertures formed therein, wherein the dispenser cap includes a mounting flange that extends around the cap body, wherein the dispenser cap is attached to the dispensing canister with the mounting flange, and wherein at least a portion of the plurality of apertures are oriented proximate the mounting flange;

attaching the dispenser cap to the dispensing canister such that the dispenser cap substantially covers an upper surface of the dispensing canister;

immersing the dispensing canister and the dispenser cap in water such that the water enters the interior cavity through the plurality of apertures and is in fluid communication with the upper surface of the dispensing canister to thereby change the temperature of the product stored in the dispensing canister;

removing the dispensing canister and the dispenser cap from the water;

draining the water from the interior cavity through the plurality of apertures; and dispensing the product from the dispensing canister using the dispensing mechanism wherein the dispensing mechanism comprises a depressible dispensing tab and a tube disposed in the interior cavity, wherein a first end of the tube is coupled to an external dispensing aperture disposed on the cap body and a second end of the tube is coupled to a connector of the depressible dispensing tab.

2. The method of claim 1, wherein the temperature of the product is increased.

3. The method of claim 1, wherein the dispensing canister is a pressurized canister and the product is a shaving cream or shaving gel.

4. The method of claim 1, and further comprising operably attaching the connector to a dispensing valve on the upper surface of the dispensing canister, wherein the dispensing valve is in operable communication with the depressible dispensing tab.

5. The method of claim 1, wherein the step of forming the dispenser cap further comprises forming the depressible dispensing tab as a top portion of the dispenser cap and sizing the depressible dispensing tab to provide a gap between the depressible dispensing tab and the cap body.

6. A method of changing a temperature of a product that is to be dispensed from a dispensing canister, the method comprising the steps of:

forming a dispenser cap comprising a cap body defining an interior cavity, wherein the cap body has a dispensing mechanism and a plurality of apertures formed therein, wherein the dispenser cap includes a mounting flange that extends around the cap body, wherein the dispenser cap is attached to the dispensing canister with the mounting flange, and wherein at least a portion of the plurality of apertures are oriented proximate the mounting flange;

attaching the dispenser cap to the dispensing canister such that the dispenser cap substantially covers an upper surface of the dispensing canister;

placing the dispensing canister and the dispenser cap in a stream of running water such that the water enters the interior cavity of the cap body through the plurality of apertures, flows through the interior cavity in fluid communication with the upper surface of the dispensing canister, and exits the interior cavity through the plurality of apertures;

removing the dispensing canister and the dispenser cap from the stream of running water;

draining the water from the interior cavity through the plurality of apertures; and dispensing the product from the dispensing canister using the dispensing mechanism wherein the dispensing mechanism comprises a depressible dispensing tab and a tube disposed in the interior cavity, wherein a first end of the tube is coupled to an external dispensing aperture disposed on the cap body and a second end of the tube is coupled to a connector of the depressible dispensing tab.

7. The method of claim 6, wherein the temperature of the product is increased.

8. The method of claim 6, wherein the dispensing canister is a pressurized canister and the product is a shaving cream or shaving gel.

9. The method of claim 6, and further comprising operably attaching the connector to a dispensing valve on the upper surface of the dispensing canister, wherein the dispensing valve is in operable communication with the depressible dispensing tab.

10. The method of claim 6, wherein the step of forming the dispenser cap further comprises forming the depressible dispensing tab as a top portion of the dispenser cap and sizing the depressible dispensing tab to provide a gap between the depressible dispensing tab and the cap body.

11. A product dispensing apparatus for dispensing product having a temperature that is different than ambient temperature, the product dispensing apparatus comprising:

a dispensing canister having a product stored therein and a dispensing valve in an upper surface thereof; and a dispenser cap comprising a cap body defining an interior cavity, wherein the cap body has a dispensing mechanism and a plurality of apertures formed therein, wherein the dispenser cap is attached to the dispensing canister to substantially cover the upper surface, wherein the plurality of apertures are adapted to allow water to flow into and out of the interior cavity of the cap body to change the temperature of the product contained in the dispensing canister prior to being dispensed, wherein the dispenser cap includes a mounting flange that extends around the cap body, wherein the dispenser cap is attached to the dispensing canister with the mounting flange, and wherein at least a portion of the plurality of apertures are oriented proximate the mounting flange wherein the dispensing mechanism comprises a depressible dispensing tab and a tube disposed in the interior cavity, wherein a first end of the tube is coupled to an external dispensing aperture disposed on the cap body and a second end of the tube is coupled to a connector of the depressible dispensing tab.

12. The product dispensing apparatus of claim 11, wherein the dispensing canister is a pressurized canister and the product is shaving cream or shaving gel.

13. The product dispensing apparatus of claim 11, and further comprising operably attaching the connector to a dispensing valve on the upper surface of the dispensing canister, wherein the dispensing valve is in operable communication with the depressible dispensing tab.

* * * * *